US005291656A

United States Patent [19]

Burns

[11] Patent Number: 5,291,656

[45] Date of Patent: Mar. 8, 1994

[54] BUTTON REMOVAL TOOL

[76] Inventor: Robert L. Burns, 16389 Cutten Dr., Guerneville, Calif. 95446

[21] Appl. No.: 20,607

[22] Filed: Feb. 22, 1993

[51] Int. Cl.[5] ..... B26B 19/06

[52] U.S. Cl. ..... 30/134

[58] Field of Search ..... 30/134, 135, 201; 56/328.1, 330, 331, 333, 335, 334

[56] References Cited

U.S. PATENT DOCUMENTS

| | | | |
|---|---|---|---|
| 476,059 | 5/1872 | Morris | 56/331 |
| 519,999 | 3/1894 | Godbey | 56/331 |
| 786,855 | 4/1905 | Tatum | 56/331 |
| 925,212 | 6/1909 | McConville | 56/333 |
| 1,732,252 | 10/1929 | Blue | 56/331 |
| 2,403,294 | 7/1946 | Morrell | 56/331 |
| 3,374,541 | 3/1968 | Earnest et al. | 30/134 |
| 3,902,306 | 9/1975 | Rosenberg | 56/333 |

*Primary Examiner*—Richard K. Seidel
*Assistant Examiner*—Paul M. Heyrana, Sr.
*Attorney, Agent, or Firm*—Leon Gilden

[57] ABSTRACT

A tool structure having a V-shaped body and confronting leg plates is provided to sever connecting thread of a button member relative to a garment and the like. The blades include confronting V-shaped cutting edges for severing of the thread. The structure is arranged to optionally include a button securement member to prevent inadvertent loss of the buttons subsequent to the severing procedure.

1 Claim, 4 Drawing Sheets

FIG 3
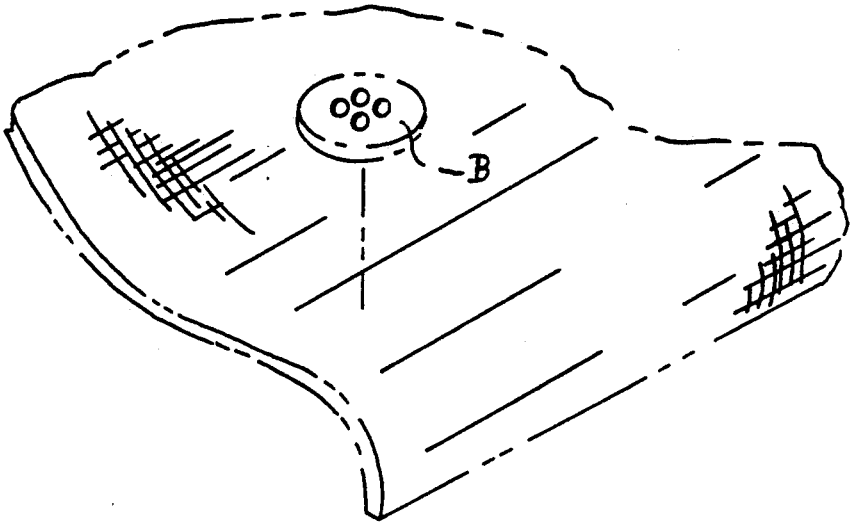
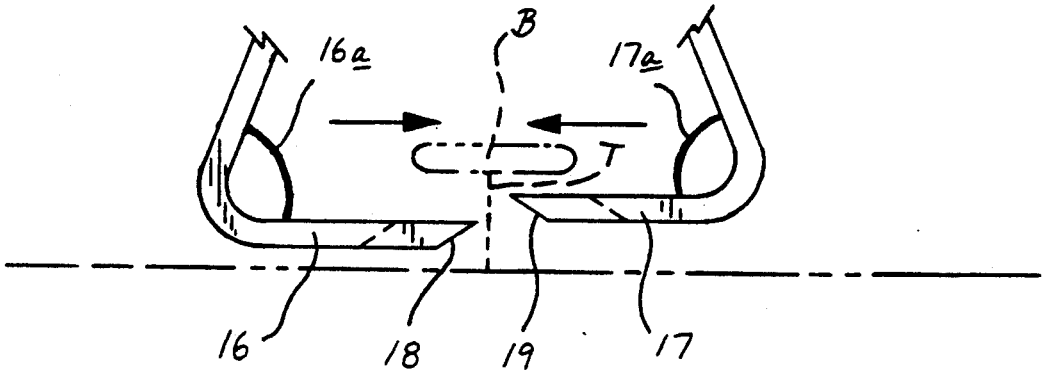
FIG 4

BUTTON REMOVAL TOOL

BACKGROUND OF THE INVENTION

1. Field of the Invention

The field of invention relates to thread cutting apparatus, arid more particularly pertains to a new and improved button removal tool wherein the same is arranged for the severing of connecting thread of a button relative to a fabric.

2. Description of the Prior Art

Button cutting tools, and more particularly thread cutting structure, is available in the prior art as indicated by U.S. Pat. No. 250,629.

The prior art structure has heretofore failed to provide means for containing a button member subsequent to the severing procedure and in this respect, the present invention substantially fulfills this need.

SUMMARY OF THE INVENTION

In view of the foregoing disadvantages inherent in the known types of button removal tool now present in the prior art, the present invention provides a button removal tool wherein the same is arranged for the severing and capturing of buttons from fabric webs. As such, the general purpose of the present invention, which will be described subsequently in greater detail, is to provide a new and improved button removal tool which has all the advantages of the prior art button removal tool and none of the disadvantages.

To attain this, the present invention provides a tool structure having a V-shaped body and confronting leg plates to sever connecting threads of a button member relative to a garment and the like. The blades include confronting V-shaped cutting edges for severing of the threads. The structure is arranged to optionally include a button securement member to prevent inadvertent loss of tile buttons subsequent to the severing procedure.

My invention resides not in any one of these features per se, but rather in the particular combination of all of them herein disclosed ar)d claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved button removal tool which has all the advantages of the prior art button removal tools and none of the disadvantages.

It is another object of the present invention to provide a new and improved button removal tool which may be easily and efficiently manufactured and marketed.

It is a further object of the present invention to provide a new and improved button removal tool which is of a durable and reliable construction.

An even further object of the present invention is to provide a new and improved button removal tool which is susceptible of a low cost of manufacture with regard to both materials and labor, and which accordingly is then susceptible of low prices of sale to the consuming public, thereby making such button removal tools economically available to the buying public.

Still yet another object of the present invention is to provide a new and improved button removal tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a button member mounted relative to a fabric web.

FIG. 4 is an orthographic partial elevational view of the confronting blades of the invention.

DESCRIPTION OF THE PREFERRED EMBODIMENT

Figure 1:
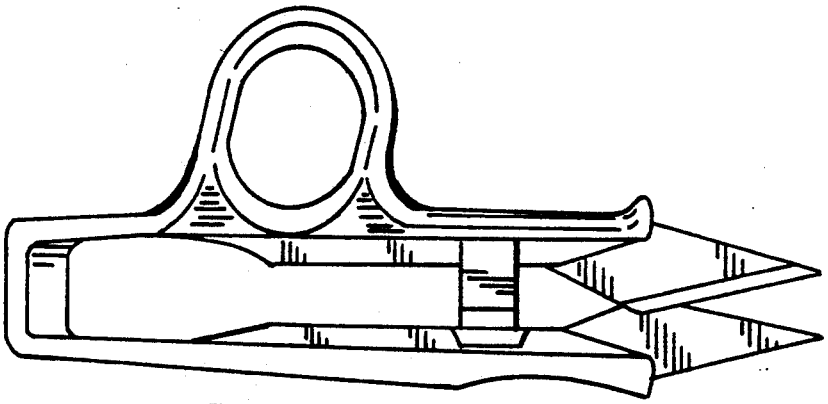
FIG 1 PRIOR ART
FIG. 1 is an orthographic side view of a prior art thread severing tool.
Figure 2:
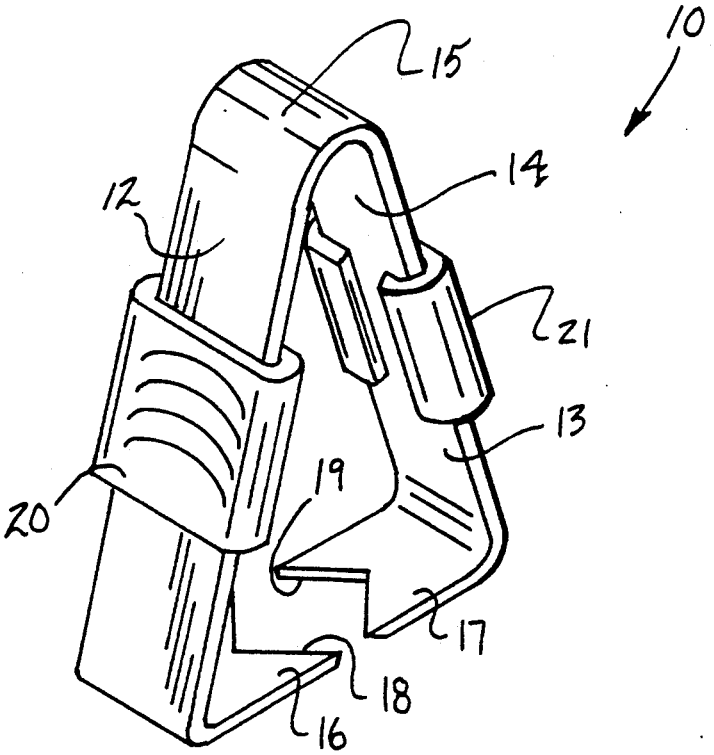
FIG. 2 is an isometric illustration of the invention.

With reference now to the drawings, and in particular to FIGS. 1 to 8 thereof, a flew and improved button removal tool embodying the principles and concepts of the present invention and generally designated by the reference numeral 10 will be described.

FIG. 1 indicates a prior art thread severing structure, such as indicated in U.S. Pat. No. 250,629, having confronting blades operative in a confronting manner to sever a thread cutting structure.

More specifically, the button removal tool 10 of the instant invention essentially comprises a generally V-shaped body, having a first leg 12 in spring-biased communication to a second blade leg 13 at a leg junction 15 defining an acute leg angle 14 therebeteween. The first and second legs are arranged in a spring-biased spaced relationship as indicated configuring the V-shape body of a shape-retentive construction. A first leg cutter blade 16 is mounted to a remote end of the first blade leg 12, with a second leg cutter blade 17 mounted to a remote end portion of the second blade leg 13, wherein the first and second leg cutter blades 16 and 17 ave mounted in confronting spaced adjacency relative to one another in parallel relationship to provide for sliding overlapping engagement relative to one another during a severing procedure. The first cutter blade 16 includes a first V-shaped cutting edge 18 in facing relationship to a second V-shaped cutting edge 19 of the second blade 17. In this manner, tile V-shaped cutting edges 18 and 19 capture a thread portion "T" therebetween to remove a button "B", as indicated in FIG. 4, from an underlying fabric garment, as set forth in FIG. 3. The first and second leg cutter blades 16 and 17 accordingly permit securement or at least positioning of the button "B" onto the cutter blades 16 and 17 subsequent to a severing procedure to support the button preventing its loss. Arranged in a wrapped engagement about the first plate leg 12 is a first resilient engagement band 20, with a second resilient engagement band 21 mounted about the second plate leg 30, with the first and second bands 20 and 21 spaced from the leg junction 15 in equal predetermined spacings. The first and second bands 20 and 21, due to their resilient nonslip construction, provide for enhanced manual grasping of the first and second legs 12 and 13 to manually displace the first and second legs, as well as the first and second cutter blades 16 and 17 relative to one another.

Figure 5:
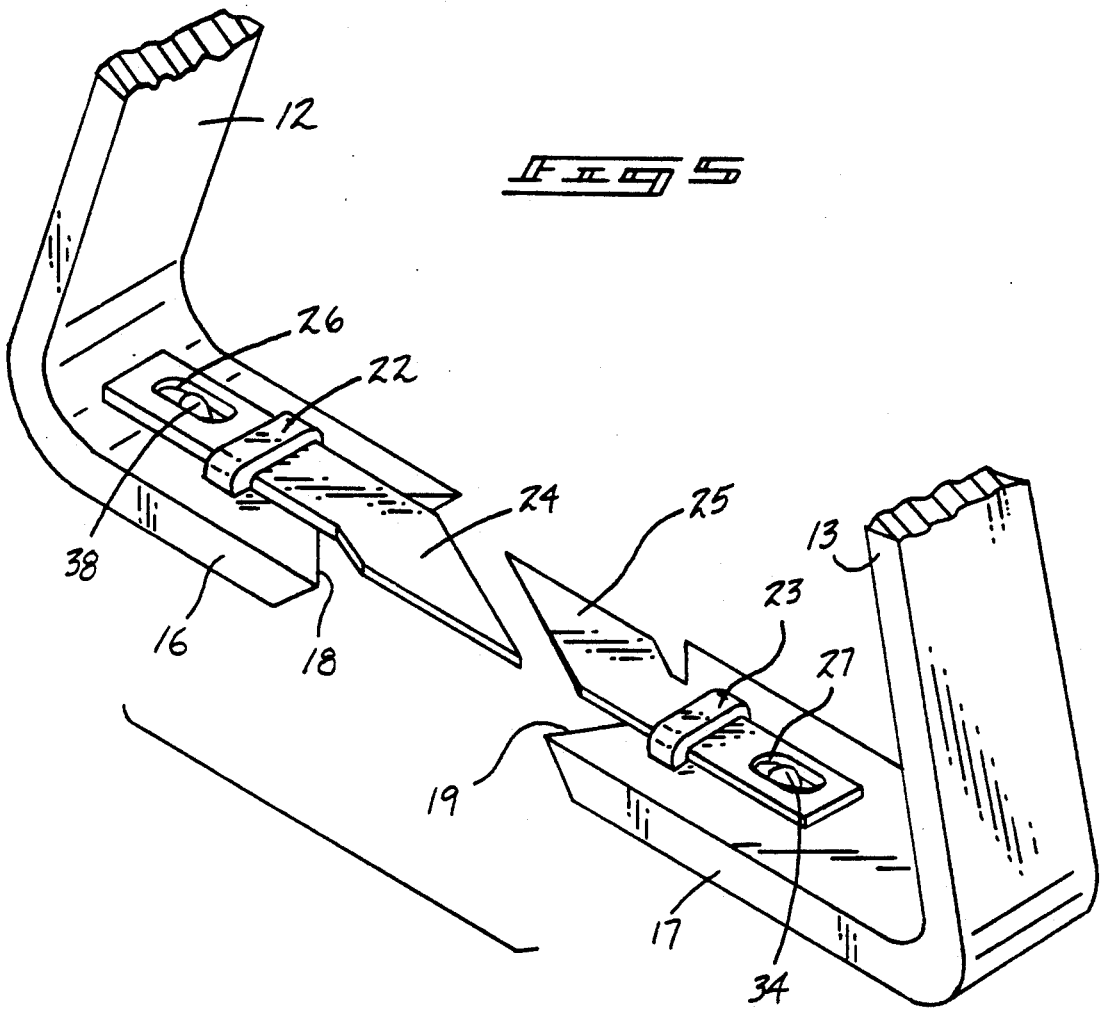
FIG. 5 is an isometric illustration of the blade members having auxiliary blade structure removably mounted thereto.
Figure 6:
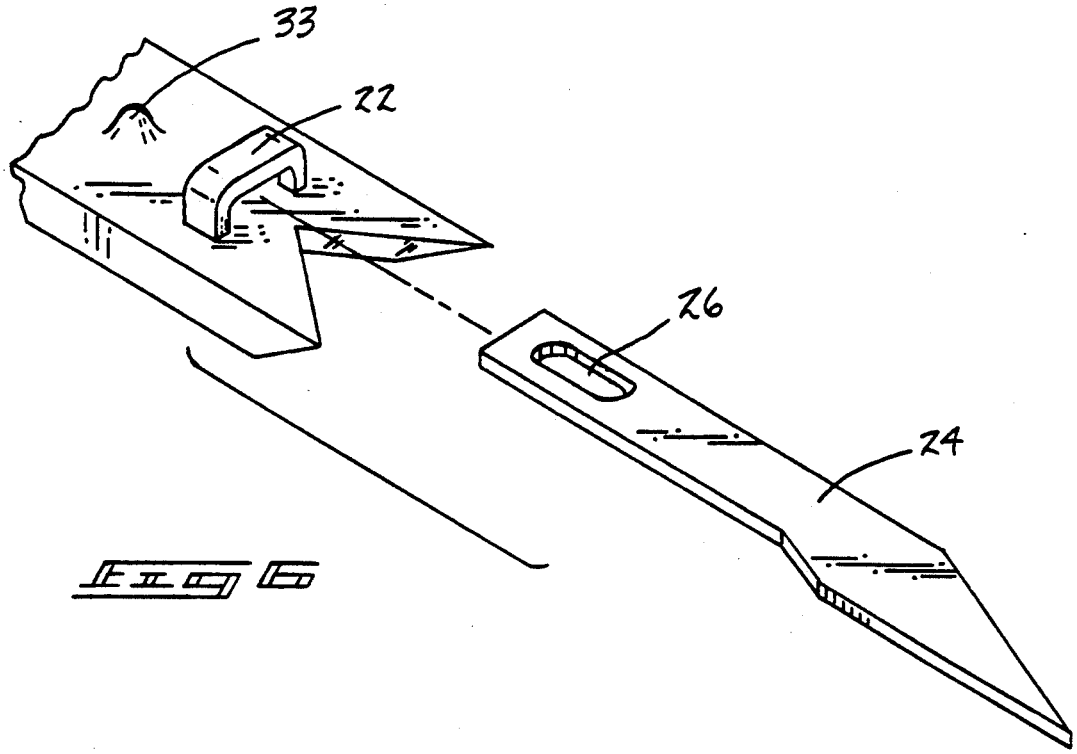
FIG. 6 is an enlarged isometric illustration of a blade member mounting an auxiliary blade.
Figure 7:
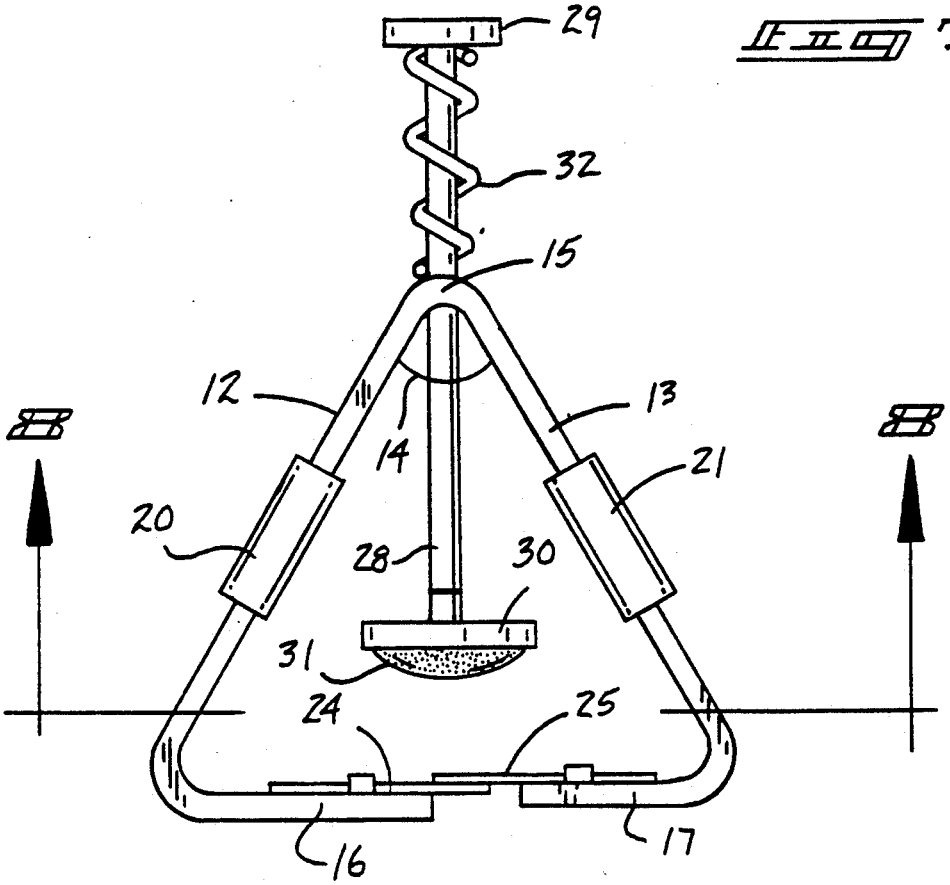
FIG. 7 is an orthographic side view of a modified aspect of the invention.

Reference to the FIGS. 5-7 indicates the use of optionally mounted first and second elongate blade members 24 and 25 mounted to top surfaces of the first and second cutter blades 16 and 17 between the first and second cutter blades and a respective junction 15. First and second elongate blade members 24 and 25 are received through respective first and second loops 22 and 23 mounted to the respective first and second cutter blades 16 and 17. The first and second elongate blade members 24 and 25 have respective first and second blade apertures 26 and 27 arranged for receiving respective first and second bosses 33 and 34 mounted to the respective first and second blades 16 and 17. In this manner, the first and second blades are arranged for securement and extended projection beyond the respective first and second cutting edges 18 and 19, whereupon lifting of the blades to permit their reception upon the top surfaces of the first and second cutter blades 16 and 17 to retract the cutter blades provides access of the first and second cutting edges 18 and 19, in a manner as indicated in the FIG. 4.

Figure 8:
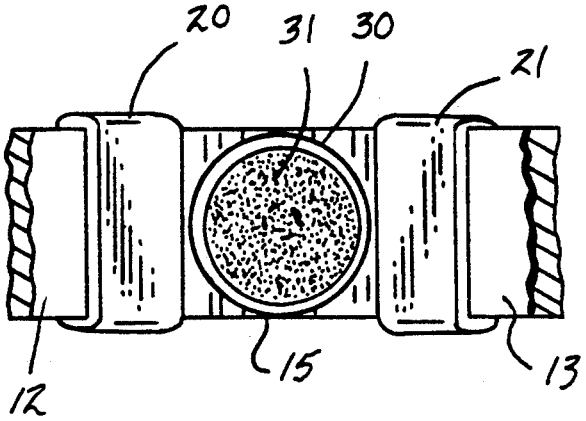
FIG. 8 is an orthographic view, taken along the lines 8—8 of FIG. 7 in the direction indicated by the arrows.

The FIGS. 7 and 8 indicates the use of an additional button engagement structure to prevent loss of the button subsequent to a severing procedure, wherein a plunger rod 28 is reciprocatably mounted through the leg junction 15, with the plunger rod orthogonally oriented relative to the first and second cutter blades 16 and 17. The plunger rod 28 includes a handle 29 at a first end of the plunger rod exteriorly of the V-shaped body of the tool structure, with the plunger rod having a head 30 positioned between the junction 15 and the cutter blades 16 and 17 spaced an equal distance relative to the first and second cutting edges 18 and 19. An adhesive dome 31 mounted to the rod head 30 in facing relationship relative to the first and second cutting edges 18 and 19 provides for grasping of a button during and subsequent to a cutting procedure to maintain engagement of the button preventing its loss and ease of dispensing and storage.

It should be noted that the first plate leg and the second plate leg are mounted to the respective first and second cutter blades 16 and 17 about first and second acute angles. Further, the use of the return spring 32 to permit biasing of the plunger rod adhesive dome 31 in a spaced relationship relative to the first and second cutter blades 16 and 17 spaces the cutter blades to permit positioning of the button between the adhesive dome and the cutter blades prior to a severing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A button removal tool, comprising, a resilient V-shaped body, having a first plate leg joined to a second plate leg at a leg junction, with the first plate leg and the second plate leg defining an acute leg angel between the first plate leg and the second plate leg at the junction, wherein the first plate leg and the second plate leg are arranged in a spring-biased relationship relative to one another to maintain the shaped-retentive configuration of the V-shaped body, with the first plate leg including a first leg end spaced from the junction, and the second leg having a second leg end spaced from the junction, wherein the first leg end includes a first cutter blade, and the second leg end includes a second cutter blade, wherein the first cutter blade and the second cutter blade are arranged in a parallel spaced relationship relative to one another, wherein the first cutter blade includes a first V-shaped cutting edge, and the second cutter blade includes a second V-shaped cutting edge, wherein the first V-shaped cutting edge and the second V-shaped cutting edge are arranged in a facing relationship relative to one another offset relative to one another to receive a button thread therebetween to permit severing of the button thread upon manual displacement of the first V-shaped cutting edge beyond the second V-shaped cutting edge, and a first resilient band mounted about the first plate leg, and a second resilient band mounted about the second plate leg, wherein the first band and the second band are spaced from the junction an equal distant predetermined spacing for enhanced manual engagement of the first plate and the second plate leg, and a first loop mounted to a first top surface of the first plate leg between the first plate leg and the junction, and a second loop mounted to the second plate leg to a second top surface of the second plate leg oriented between the second plate leg and the junction, and a first elongate blade member slidably mounted within the first loop and a second elongate blade member slidably mounted within the second loop, with the first elongate blade member and second blade member including respective first and second blade apertures, and the first top surface and the second bosses, wherein the first boss is received within the first blade aperture and the second boss is received within the second blade aperture for maintaining selective projection of the first blade member and the second blade member beyond the respective first cutting edge and the second cutting edge, and a plunger rod reciprocatably mounted through the junction orthogonally oriented relative to the first plate leg and the second plate leg, with the plunger rod including a plunger rod handle fixedly mounted to the plunger rod exteriorly of the junction, and a plunger rod mounted to the plunger rod within the V-shaped body, and the plunger rod head includes an adhesive dome positioned an equal distance between the first cutting edge and the second cutting edge and oriented between the first plate leg, the second plate leg, and the junction, with a return spring biasing of the adhesive dome in a spaced relationship relative to the first plate leg and the second plate leg.

* * * * *